US007845989B2

(12) United States Patent
Hiramatsu et al.

(10) Patent No.: US 7,845,989 B2
(45) Date of Patent: Dec. 7, 2010

(54) CONNECTOR

(75) Inventors: Hiroyuki Hiramatsu, Yokkaichi (JP); Brian Nagy, Woodhaven, MI (US); Martin Spencer, Milford, MI (US); Kevin Davis, Brighton, MI (US); Lalee Xiong, Novi, MI (US)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/367,709

(22) Filed: Feb. 9, 2009

(65) Prior Publication Data

US 2010/0203759 A1 Aug. 12, 2010

(51) Int. Cl.
*H01R 13/802* (2006.01)

(52) U.S. Cl. ..... 439/701; 439/562; 439/595; 439/553

(58) Field of Classification Search ..... 439/562–563, 439/553, 701, 595
See application file for complete search history.

(56) References Cited

U.S. PATENT DOCUMENTS

| | | | | |
|---|---|---|---|---|
| 5,344,347 | A * | 9/1994 | Inoue et al. | 439/701 |
| 5,855,486 | A * | 1/1999 | Fukamachi et al. | 439/157 |
| 6,575,794 | B1 * | 6/2003 | Nakamura | 439/701 |
| 6,739,893 | B2 * | 5/2004 | Hallitschke et al. | 439/248 |
| 7,090,533 | B1 | 8/2006 | Houck et al. | |

* cited by examiner

*Primary Examiner*—Truc T Nguyen
(74) *Attorney, Agent, or Firm*—Gerald E. Hespos; Michael J. Porco

(57) ABSTRACT

A connector (M) includes a terminal fitting accommodation member (20), made of synthetic resin, which accommodates a plurality of terminal fittings (30) and a tube (10), produced separately from the terminal fitting accommodation member (20), a front end of which is mounted in a mounting hole (H) of a panel. The connector (M) is constructed by mounting the terminal fitting accommodation member (20) on the tube (10).

15 Claims, 16 Drawing Sheets

CONNECTOR

BACKGROUND OF THE INVENTION

1. Field of the Invention

The invention relates to a connector.

2. Description of the Related Art

U.S. Pat. No. 7,090,533 discloses a connector with a housing made of synthetic resin. The housing has a terminal accommodation and a forwardly projecting hood that can be mounted in a mounting hole of a panel. Cavities are formed in the terminal accommodation part and accommodate terminal fittings of a wire harness.

Not all wiring harnesses have the same number of wires, and connectors of the type disclosed in U.S. Pat. No. 7,090,533 can be used with wiring harnesses that have different numbers of electric wires. Accordingly, the number of poles of terminal fittings accommodated in the terminal accommodation part can vary. Therefore, it is necessary to produce connectors with housings that have different numbers of cavities and different positions for the cavities. A die is used to form a housing that has a specified number of cavities in specified positions. Therefore, the number of dies needed to form the housings increases as the number of different types of housings increases to meet the specifications for the number of the poles of the terminal fittings. Thus, the cost for producing the dies becomes high.

The invention has been completed in view of the above-described situation. Therefore it is an object of the invention to decrease the cost for producing a die when the number of poles to be accommodated in cavities of a terminal fitting accommodation member is altered.

SUMMARY OF THE INVENTION

The invention relates to a connector with a terminal fitting accommodation member made of synthetic resin and configured to accommodate a plurality of terminal fittings. The connector also includes a tube formed separately from the terminal fitting accommodation member and configured for mounting in a mounting hole of a panel. The connector is assembled by mounting the terminal fitting accommodation member on a rear end of the tube.

A tab preferably is disposed at a front end of the terminal fitting. The tab projects from a front-end surface of the terminal fitting accommodation member and is accommodated in a space surrounded by the tube. A female housing can be fit in the tube from a front end thereof. A female terminal fitting is accommodated in the female housing and can be connected with the tab. The terminal fitting accommodation member preferably is mounted on the tube in a direction intersecting a direction in which the female housing is fit in the tube.

The tube preferably has a prevention portion that allows the terminal fitting accommodation member to be mounted on the tube, but prevents the terminal fitting accommodation member from being displaced longitudinally.

The tube and the terminal fitting accommodation member preferably have locks that engage each other when the terminal fitting accommodation member is at a correct mounting position. The locks prevent the terminal fitting accommodation member from being displaced in a direction in which the terminal fitting accommodation member departs from the tube.

The tube may have a stop for preventing the terminal fitting accommodation member from being displaced beyond a correct mounting position.

The terminal fitting accommodation member preferably has a detector for detecting whether the terminal fitting has been accommodated correctly inside the terminal fitting accommodation member. The detector and the tube have contacts that are capable of engaging each other when the detector has been mounted on the terminal fitting accommodation member. The engagement of the contacts of the detector and the tube causes the detector to press the terminal fitting accommodation member to the stop.

The number of poles of the terminal fittings may vary from one connector to another. In this situation, a new terminal fitting accommodation member with an appropriate array of poles is mounted on the existing tube to obtain a connector. Thus, the tube is used for the newly produced connector to alter the number of the poles of the terminal fittings and it is only necessary to produce a die for forming the terminal fitting accommodation member. Furthermore, the die does not have a molding portion for molding the tube, and hence the die has a simple configuration. The more simply configured die costs less. Therefore the connector of the invention allows a lower cost for producing the die.

A clearance necessarily is provided between of the terminal fitting accommodation member the tube for performing a smooth mounting operation. Thus, there is a fear that loosening occurs in the direction in which the terminal fitting accommodation member is mounted on the tube even though the extent of the loosening is very low. However, the terminal fitting accommodation member is mounted on the tube in the direction intersecting with the direction in which the female housing is fit in the tube. Therefore even though the loosening occurs in the direction in which the terminal fitting accommodation member is mounted on the tube, the connection between the tab and the female terminal fitting remains stable.

A connection resistance between the female terminal fitting and the tab presses the terminal fitting accommodation member rearward when the female housing is fit inside the tube from the front. However, the preventing portion prevents the terminal fitting accommodation member from being displaced longitudinally. Therefore the area of the connection between the female terminal fitting and the tab is obtained securely.

Engagement between the locks holds the terminal fitting accommodation member on the tube at a correct mounting position.

The stop holds the terminal fitting accommodation member on the tube.

DETAILED DESCRIPTION OF THE PREFERRED EMBODIMENTS

Figure 1:
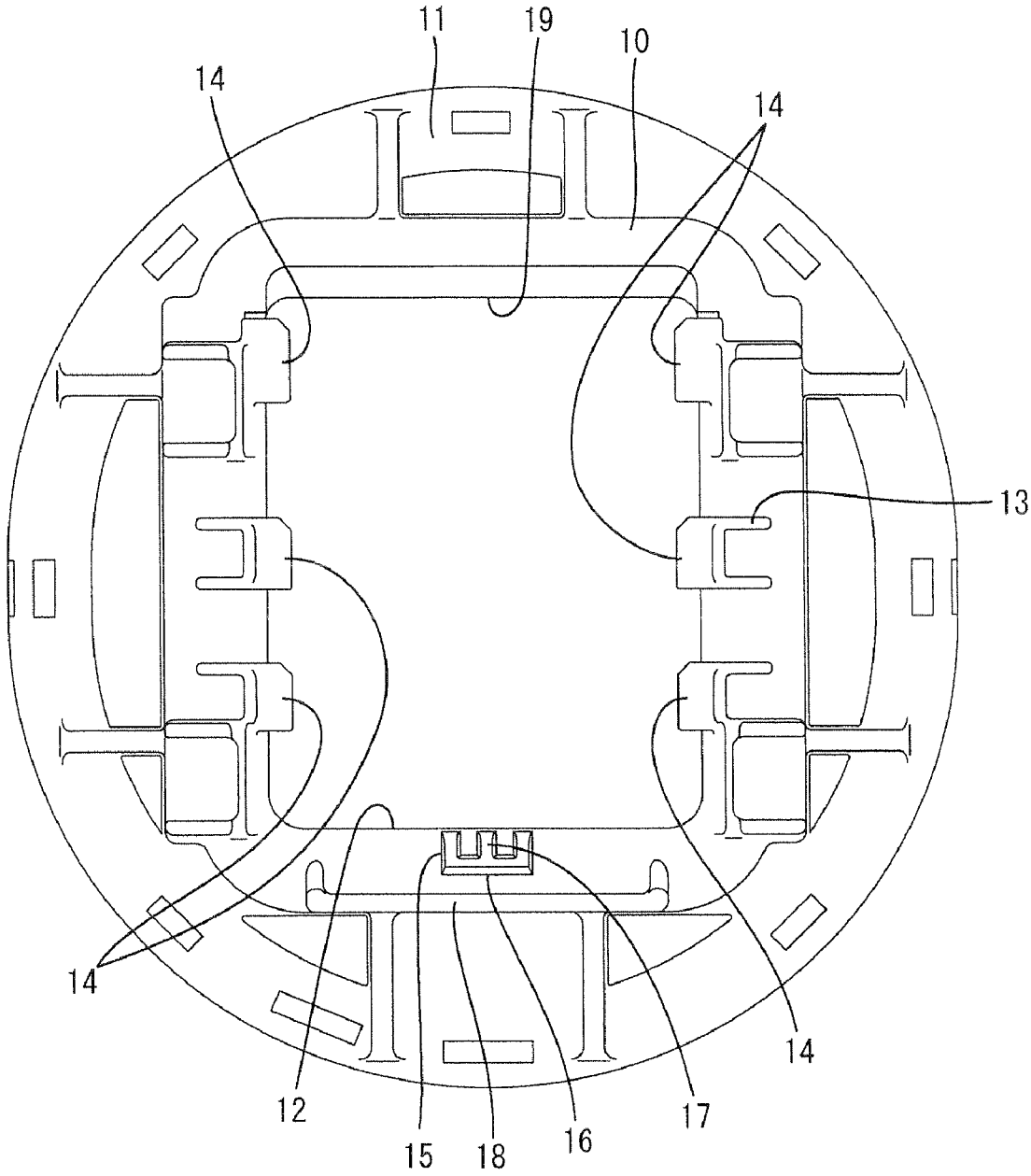
FIG. 1 is a rear view of a tube of the invention.

A connector in accordance with the invention is identified by the letter M in FIGS. 1 through 16. The connector M has a tube 10, a terminal fitting accommodation member 20 produced separately from the tube 10, male terminal fittings 30 and a detector 40. As shown in FIGS. 8 and 10, the connector M is mounted to a mounting hole H of a panel P. A female housing F can be fit in the connector M in a direction from the front of the connector M. The female housing F is block-shaped and accommodates female terminal fittings T therein.

Figure 9:
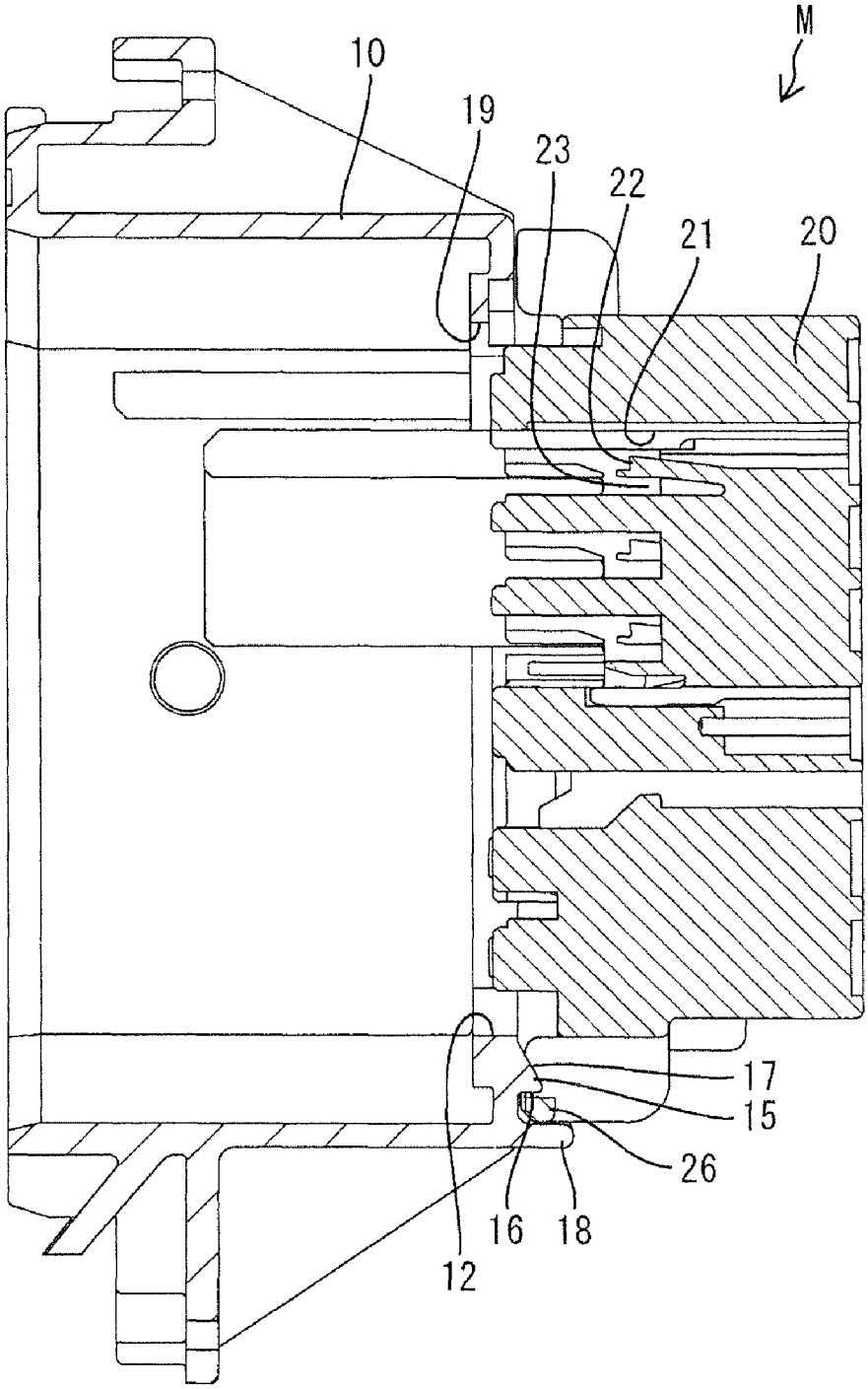
FIG. 9 is a sectional view taken along a line C-C of FIG. 7.
Figure 10:
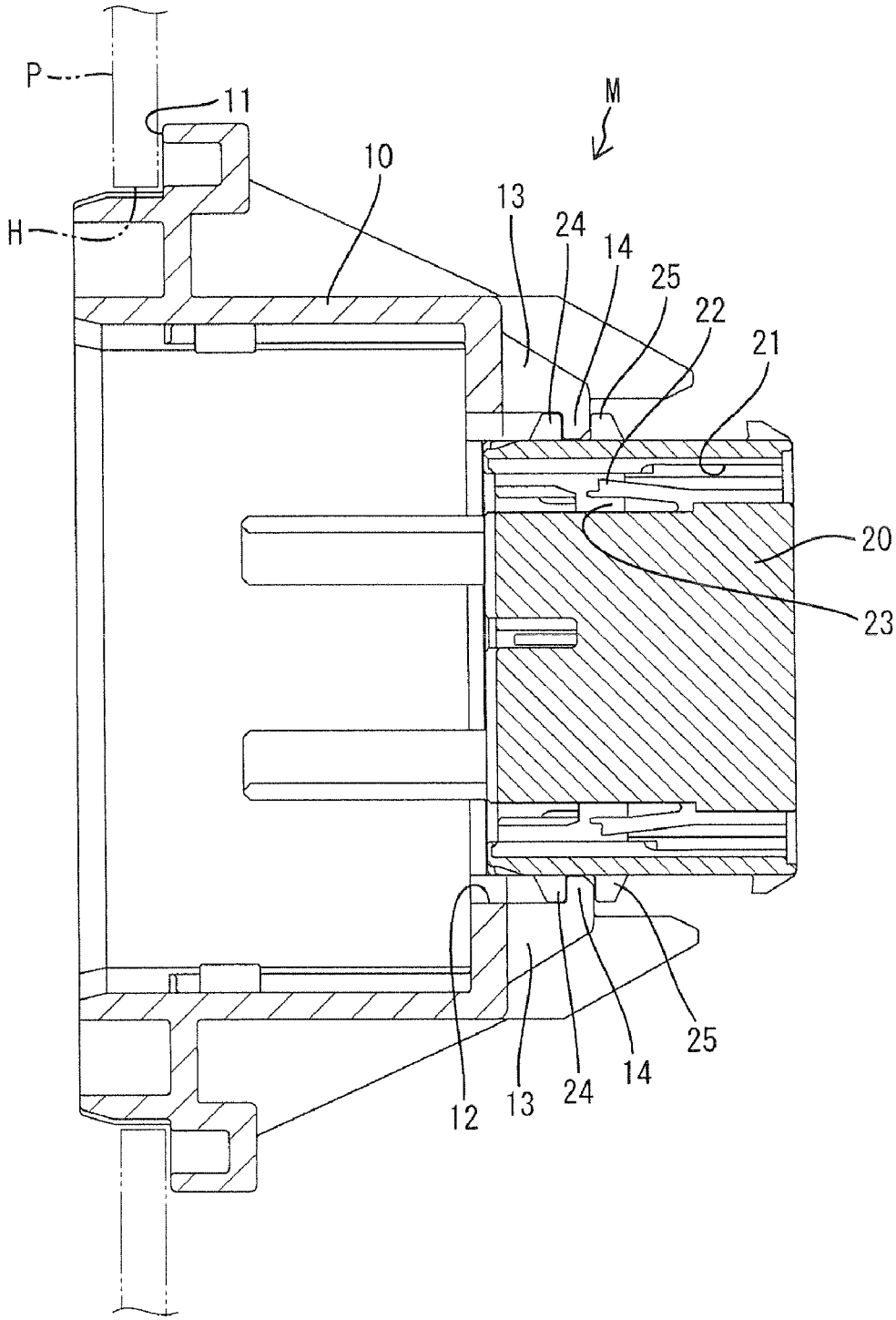
FIG. 10 is a sectional view taken along the line C-C of FIG. 7.

The tube 10 is made of synthetic resin and, as shown in FIGS. 9 through 10, is tapered so that cross sectional dimensions of the tube 10 gradually increase toward the front. The tube 10 is hollow in its longitudinal direction. An approximately circular fit-in edge 11 is formed at the front of the tube 10 and is configured to fit in the mounting hole H. A long quadrangular fit-in hole 12 is formed at the rear of the tube 10.

As shown in FIGS. 1 and 10, three vertically spaced projections 13 project rearward from a left edge of the fit-in hole 12 of the tube 10 and are bent in. Three vertically space projections 13 also project rearward from a right edge of the fit-in hole 12 of the tube 10 and are bent inward. A plate-shaped prevention portion 14 is formed at an end of each of the projections 13 and is perpendicular to the longitudinal direction of the tube 10.

A lock 15 is formed at the rear-end surface of the tube 10 and projects rearward from a lower edge of the fit-in hole 12. A locking surface 16 is formed at a lower part of the lock 15 and is perpendicular to the vertical direction of the tube 10, which is parallel with a direction in which the terminal fitting accommodation member 20 is mounted on the tube 10. A guide surface 17 is formed on upper part of the locking projection 15 and inclines to the vertical direction of the tube 10.

As best shown in FIG. 8, a stop 18 is formed on a rear-end surface of the tube 10. The stop 18 is a rib that extends left to right in a direction perpendicular to the vertical direction of the tube 10 and below the lock 15. Thus, the stop 18 is forward in the direction in which the terminal fitting accommodation member 20 is mounted on the tube 10.

As best shown in FIG. 1, a contact surface 19 faces down from an upper part of an inner peripheral surface of the fit-in hole 12. The contact surface 19 is flat and perpendicular to the direction in which the terminal fitting accommodation member 20 is mounted on the tube 10.

The terminal fitting accommodation member 20 is made of synthetic resin and is block-shaped. Longitudinally hollow terminal fitting insertion spaces 21 (see FIG. 2) are formed inside the terminal fitting accommodation member 20. A lance 22 (see FIGS. 8, 9) is cantilevered forward along an inner wall of each terminal fitting insertion space 21 of the terminal fitting accommodation member 20. The lance 22 is elastically deformable in a direction intersecting with a direction in which the male terminal fitting 30 is inserted into the terminal fitting insertion space 21. Flexible spaces 23 (see FIG. 9) are formed inside the terminal fitting accommodation member 20 for allowing elastic deformation of the lance 22. The flexible spaces 23 open on a front surface of the terminal fitting accommodation member 20.

Figure 11:
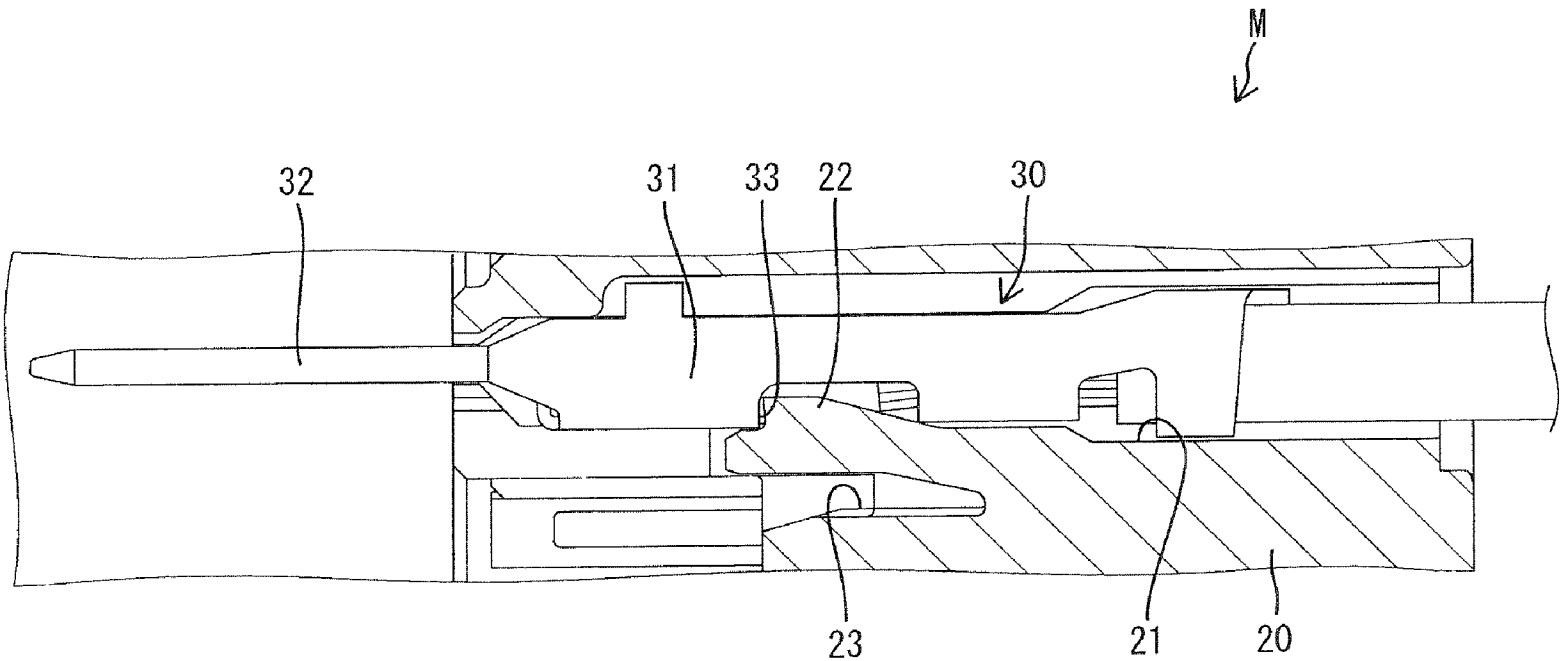
FIG. 11 is a partly enlarged sectional view showing a state in which a male terminal fitting is inserted into the terminal fitting accommodation member.
Figure 12:
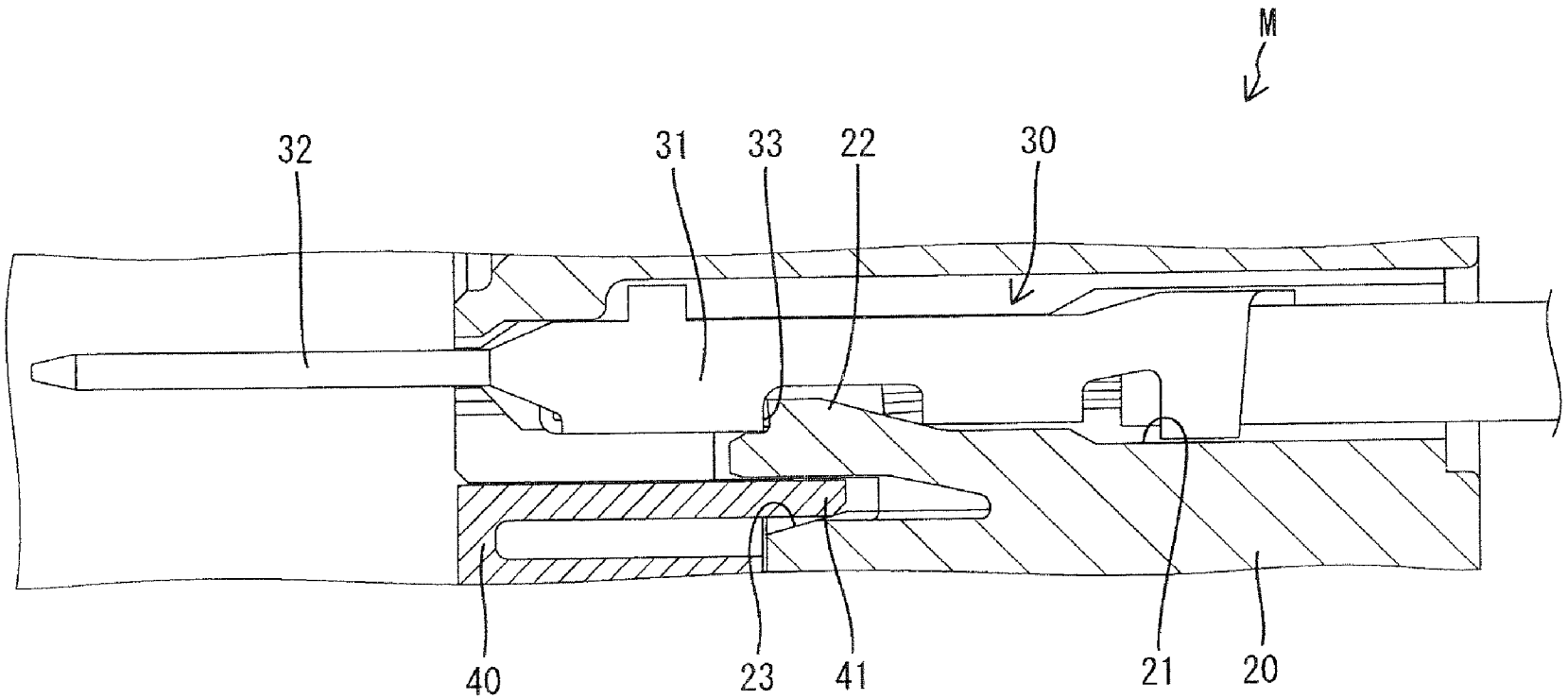
FIG. 12 is a sectional view showing the detector mounted on the terminal fitting accommodation member into which the male terminal fitting has been inserted.
Figure 13:
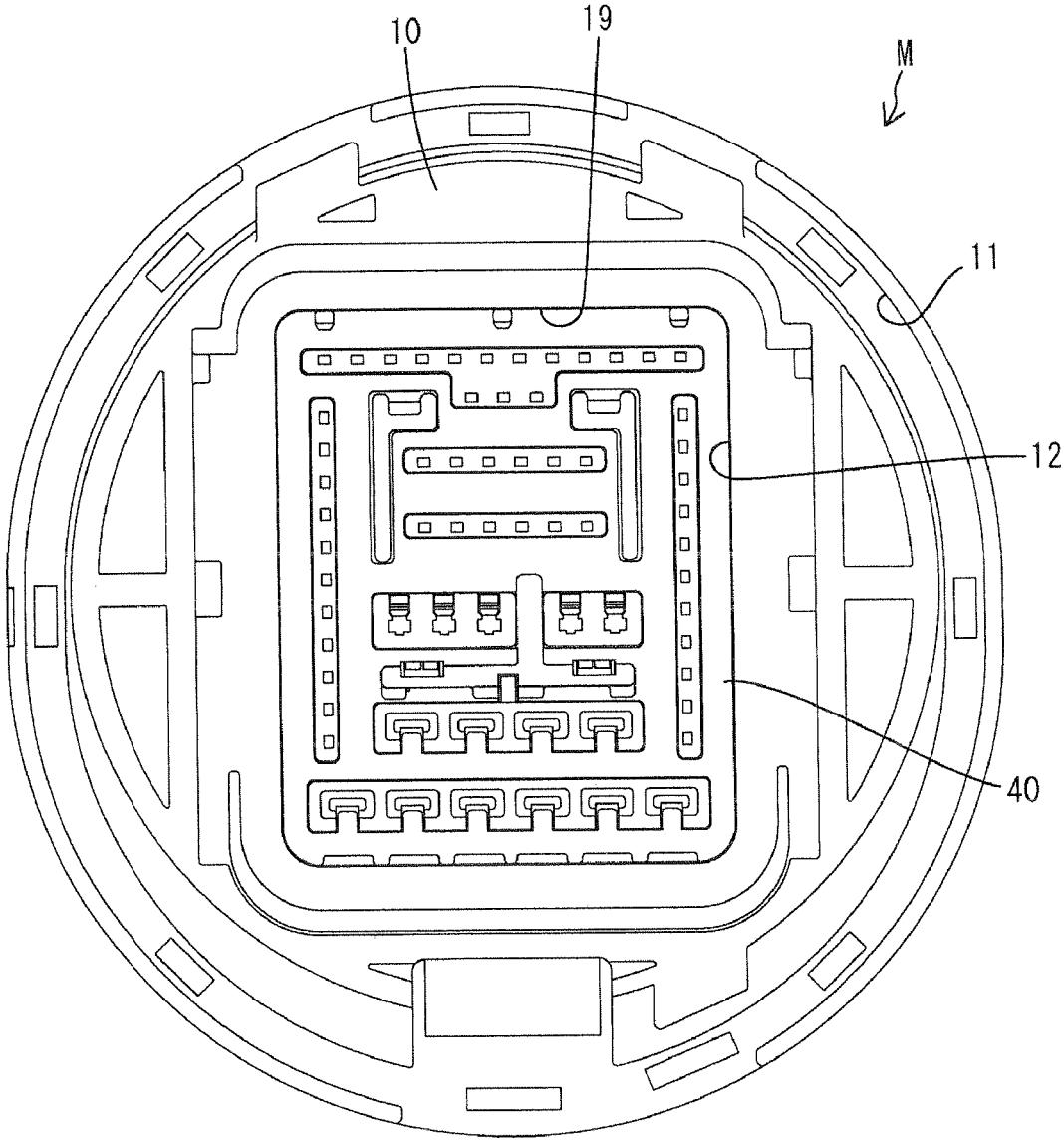
FIG. 13 is a front view showing a state in which the detector is mounted on the terminal fitting accommodation member.

The male terminal fittings 30 are inserted into the terminal fitting insertion spaces 21 (see FIG. 11) from the rear. As shown in FIGS. 11 and 12, the male terminal fitting 30 has a body 31 and a tab 32 projects forward from the body 31. The lance 22 is flexed elastically into the flexible space 23 during inserting of the male terminal fitting 30 into the respective terminal fitting insertion spaces 21 due to interference between the lance 22 and the male terminal fitting 30. The lance 22 returns elastically to its original state when the male terminal fitting 30 reaches a predetermined normal insertion position and engages a removal prevention hole 33 of the male terminal fitting 30 to prevent removal of the male terminal fitting 30.

Figure 2:
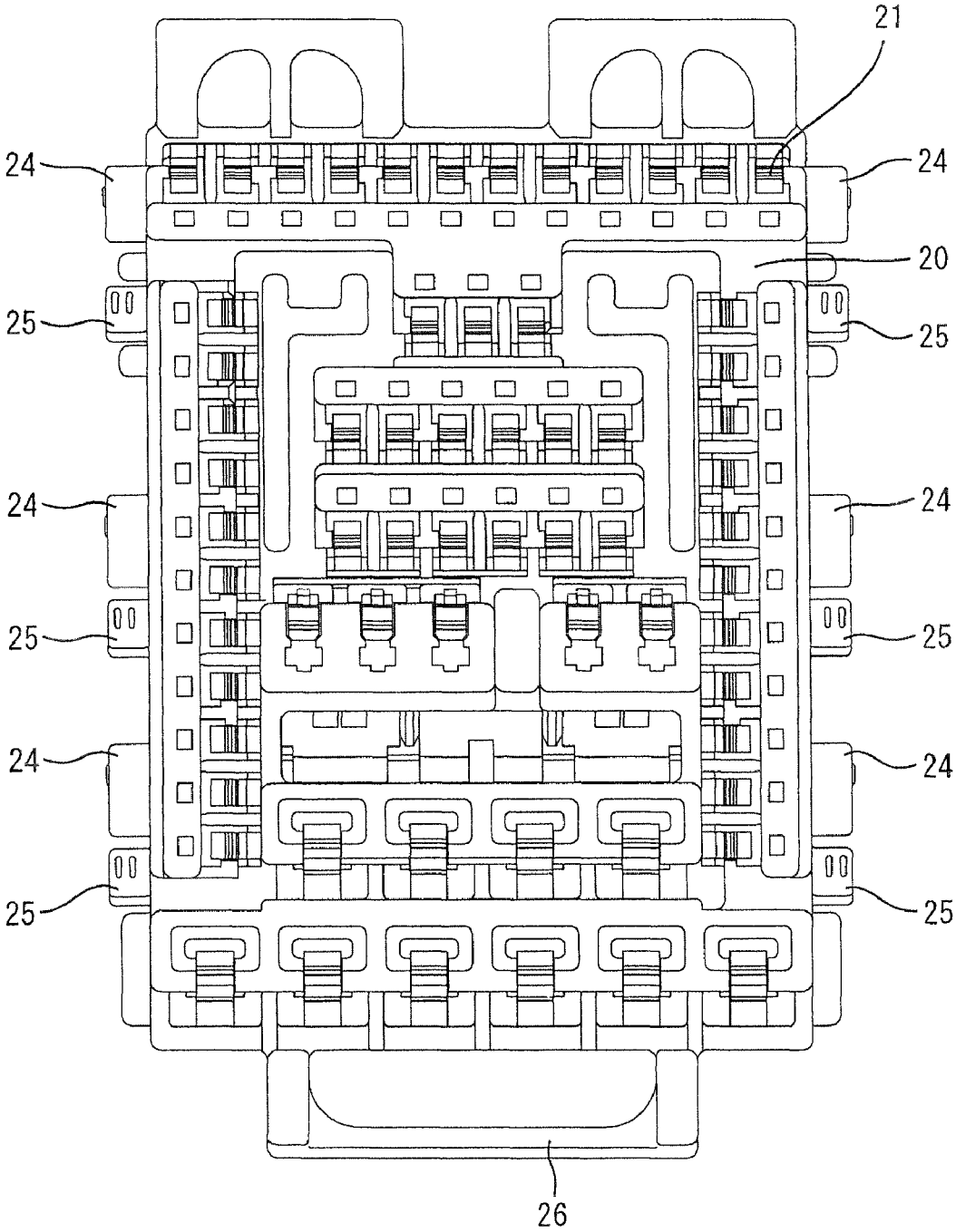
FIG. 2 is a front view showing a terminal fitting accommodation member.
Figure 3:
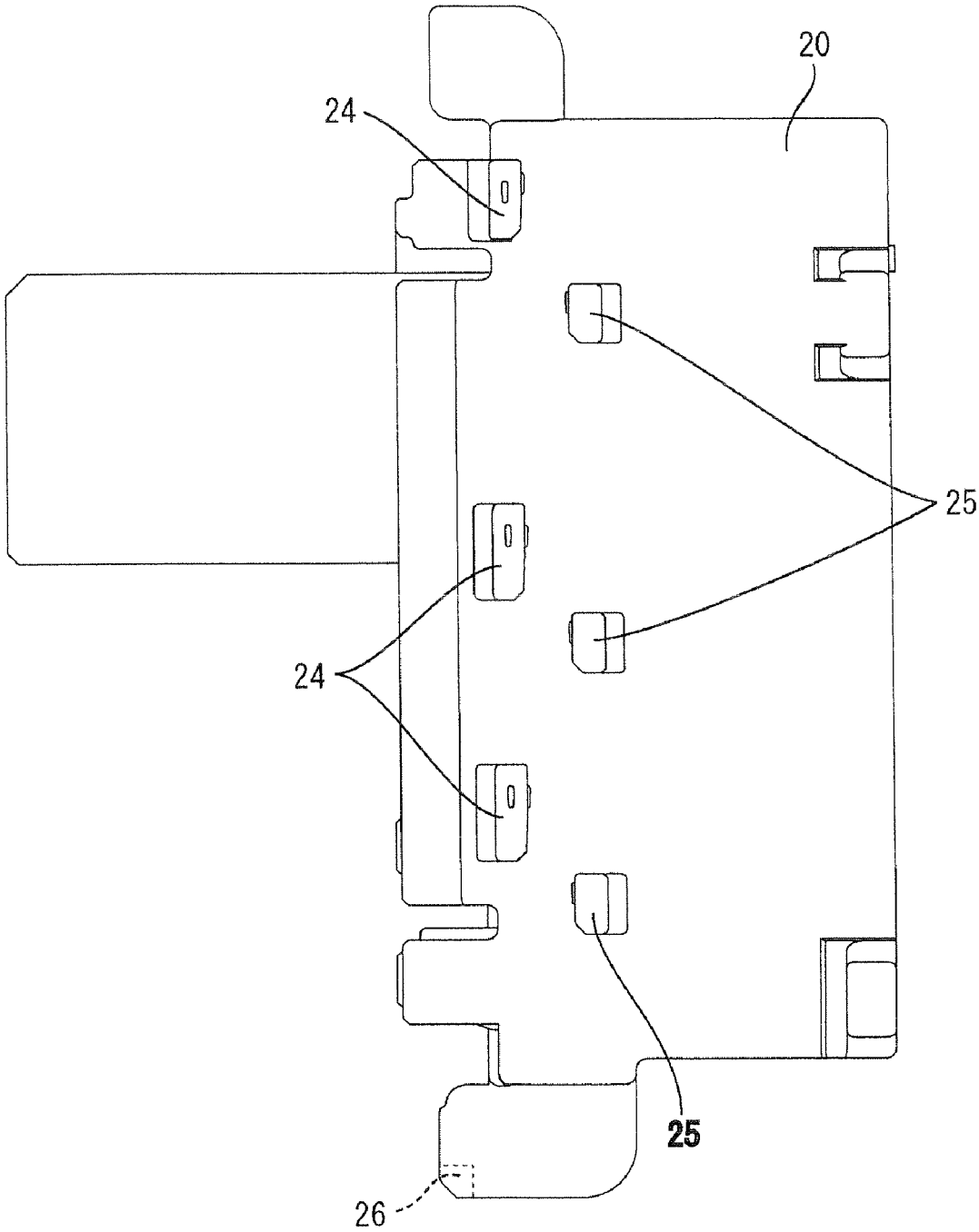
FIG. 3 is a side view showing the terminal fitting accommodation member.
Figure 4:
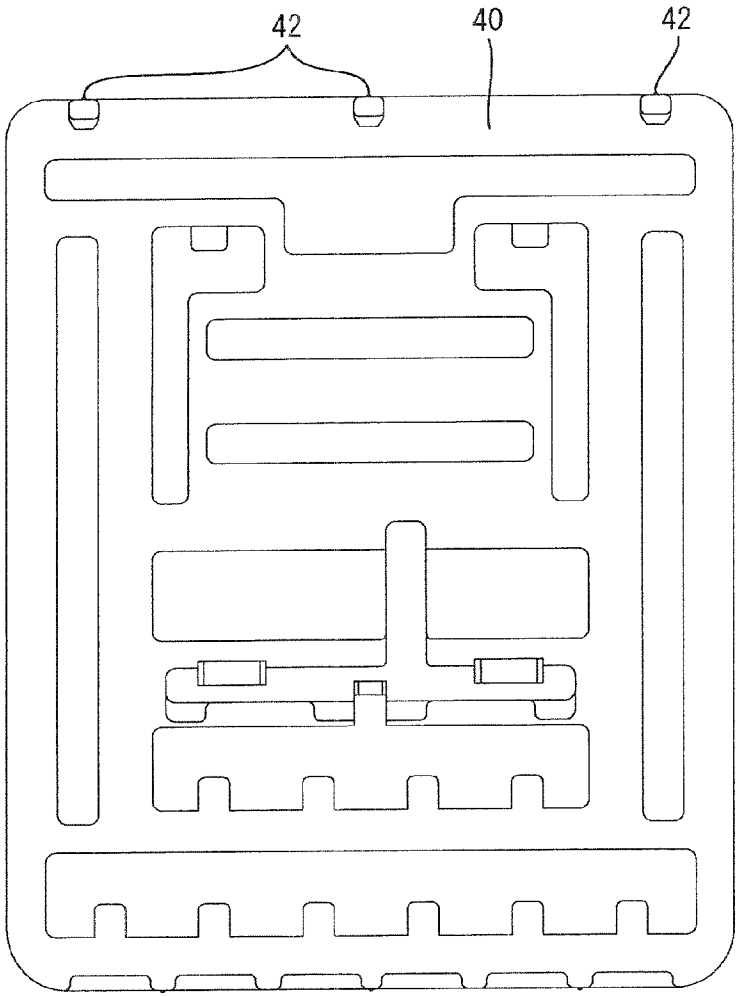
FIG. 4 is a front view showing a detector.
Figure 5:
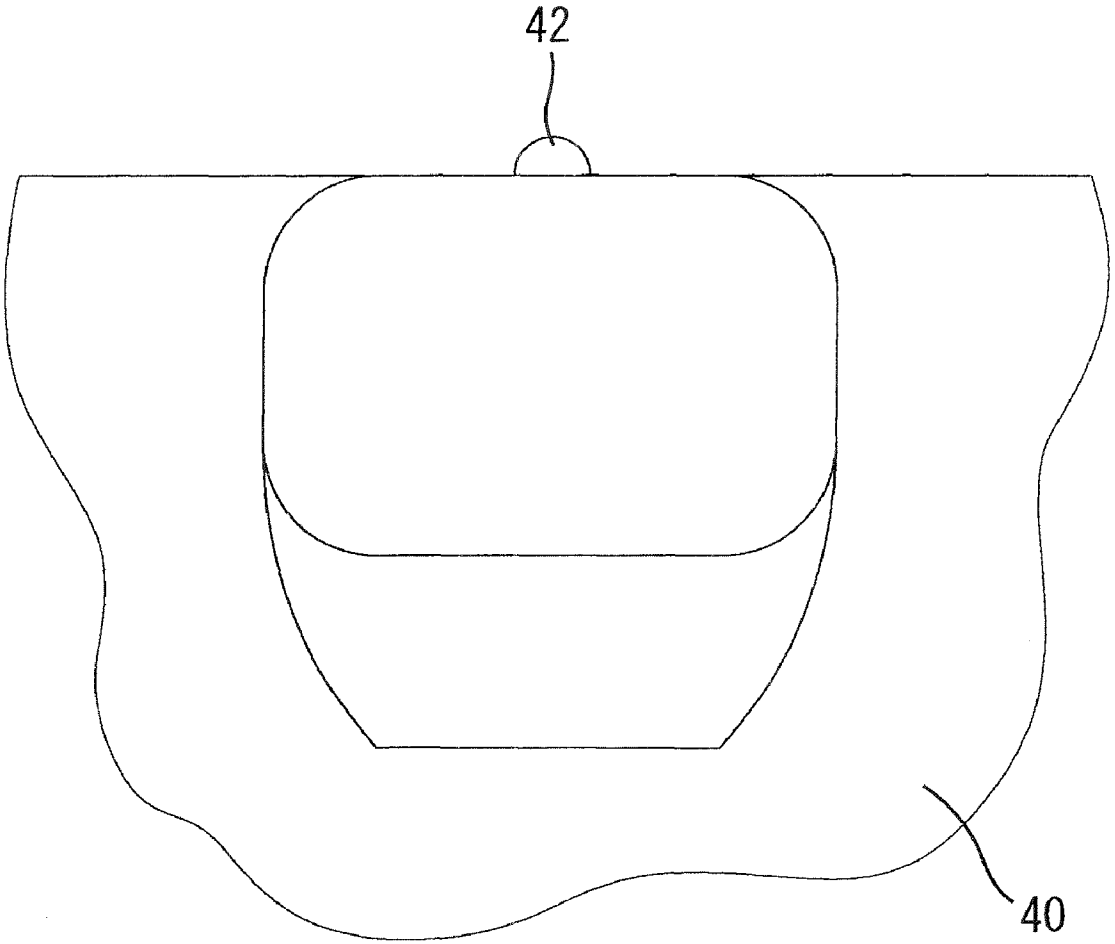
FIG. 5 is partly enlarged front view showing a pressing projection of the detector.
Figure 6:
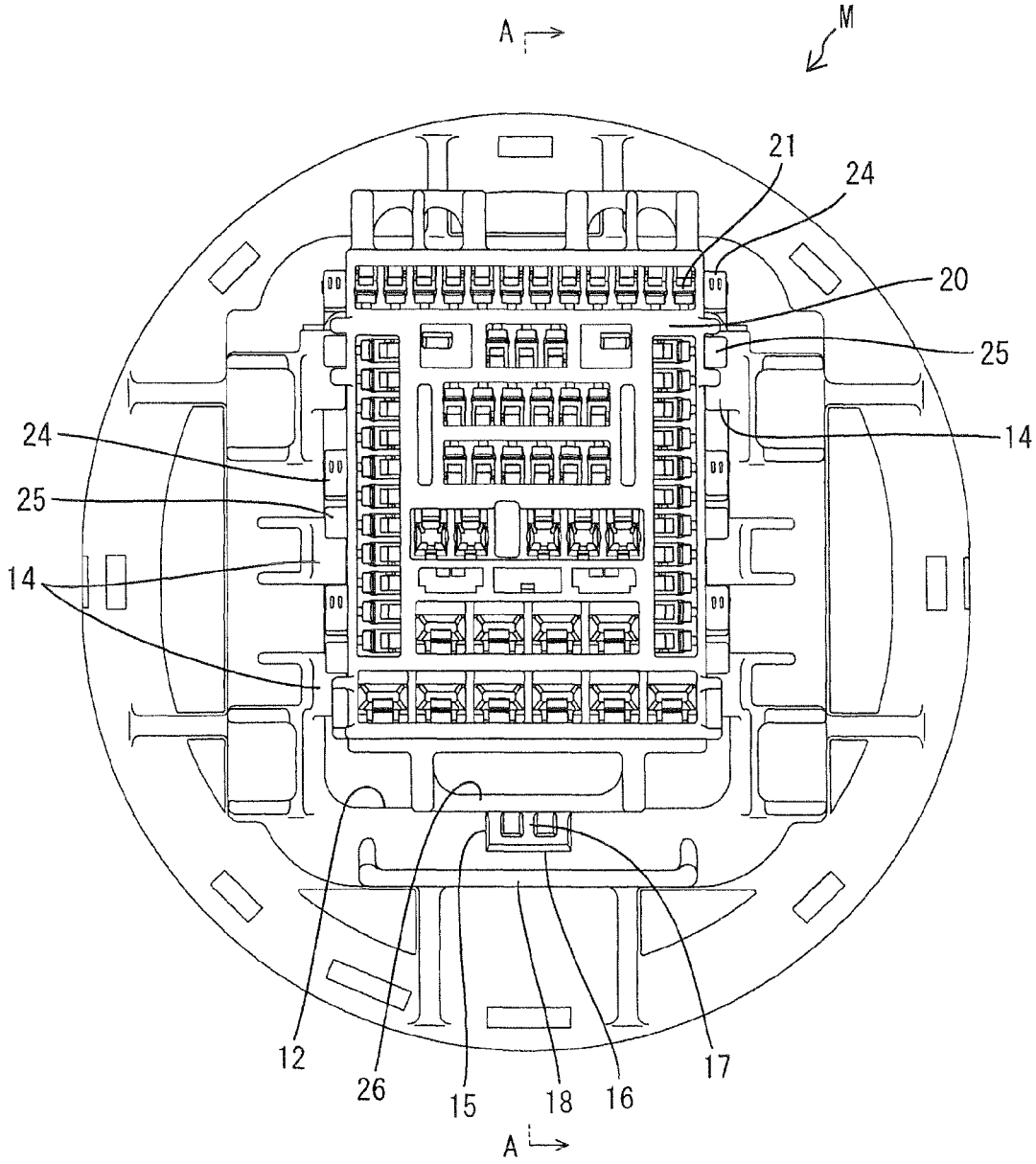
FIG. 6 is a rear view showing a state in which the terminal fitting accommodation member is being mounted on the tube.

As shown in FIGS. 2 and 3, three front projections 24 are arranged vertically at certain intervals on a left surface of the terminal fitting accommodation member 20, and three rear projections 25 are arranged vertically at certain intervals at positions rearward from the three front projections 24. Three front projections 24 also are arranged vertically at certain intervals on a right surface of the terminal fitting accommodation member 20, and three rear projections 25 are arranged vertically at certain intervals at positions rearward from the three front projections 24.

As shown in FIGS. 2 and 3, the uppermost front projection 24 is slightly higher than the uppermost rear projection 25. Similarly, the middle of the three front projections 24 is slightly higher than the middle of the three rear projections 25 and the lowermost front projection 24 is slightly higher than the lowermost rear projection 25.

A locking bar 26 (see FIGS. 6, 9) 26 is formed along a lower-end surface of the terminal fitting accommodation member 20. The locking bar 26 extends in the left-to-right direction of the terminal fitting accommodation member 20, and left and right ends of the locking bar 26 are continuous with the lower surface of the terminal fitting accommodation member 20 for support. The locking bar 26 flexes elastically so that the central portion thereof in the left-to-right direction is displaced rearward.

The detector 40 (see FIGS. 4, 5, 13, 14, 16) is made of synthetic resin and is block-shaped. Detection projections 41 (see FIGS. 12, 16) are cantilevered rearward on the detector 40 at positions corresponding to the respective flexible spaces 23 (see FIG. 9) in the terminal fitting accommodation member 20. Three pressing projections 42 (see FIG. 4) are formed on an upper-end surface of the detector 40 at certain intervals in the left-to-right direction thereof. Each pressing projections 42 is a rib in the longitudinal direction of the detector 40.

The connector M is assembled by first mounting the terminal fitting accommodation member 20 on the tube 10 from the rear. At this time, the terminal fitting accommodation member 20 is brought toward the tube 10 at a position slightly higher than a normal mounting position (see FIGS. 6 and 8) to prevent the front projections 24 of the terminal fitting accommodation member 20 from interfering with the prevention portion 14 of the tube 10. Thus, the front projections 24 are forward from the prevention portion 14 and the front projections 25 contact a rear surface of the prevention portion 14. In this state, inner side edges of the left and right prevention portions 14 contact left and right side surfaces of the terminal fitting accommodation member 20 respectively. Thus, the terminal fitting accommodation member 20 is placed in position with respect to the tube 10 in the left and right directions. The locking bar 26 of the terminal fitting accommodation member 20 is located up from the locking projection 15 of the tube 10.

The terminal fitting accommodation member 20 then is slid down relative to the tube 10. The locking bar 26 elastically flexes and rides over the locking projection 15 while sliding the terminal fitting accommodation member 20. At this time, the locking bar 26 slides on the guide surface 17, which is inclined with respect to the direction in which the terminal fitting accommodation member 20 moves. Therefore the downward sliding operation of the terminal fitting accommodation member 20 and the elastic flexure of the locking bar 26 are performed smoothly.

The elastic restoring force of the locking bar 26 urges the terminal fitting accommodation member 20 rearward with respect to the tube 10 while moving the terminal fitting accommodation member 20. However, the rear surface of the front projection 24 is in contact with the front surface of the prevention portion 14 to prevent rearward movement of the terminal fitting accommodation member 20 on the tube 10. Additionally, the rear projection 25 slides on the rear surface of the prevention portion 14 to ensure that the terminal fitting accommodation member 20 moves down along a predetermined path without moving longitudinally relative to the tube 10.

Figure 7:
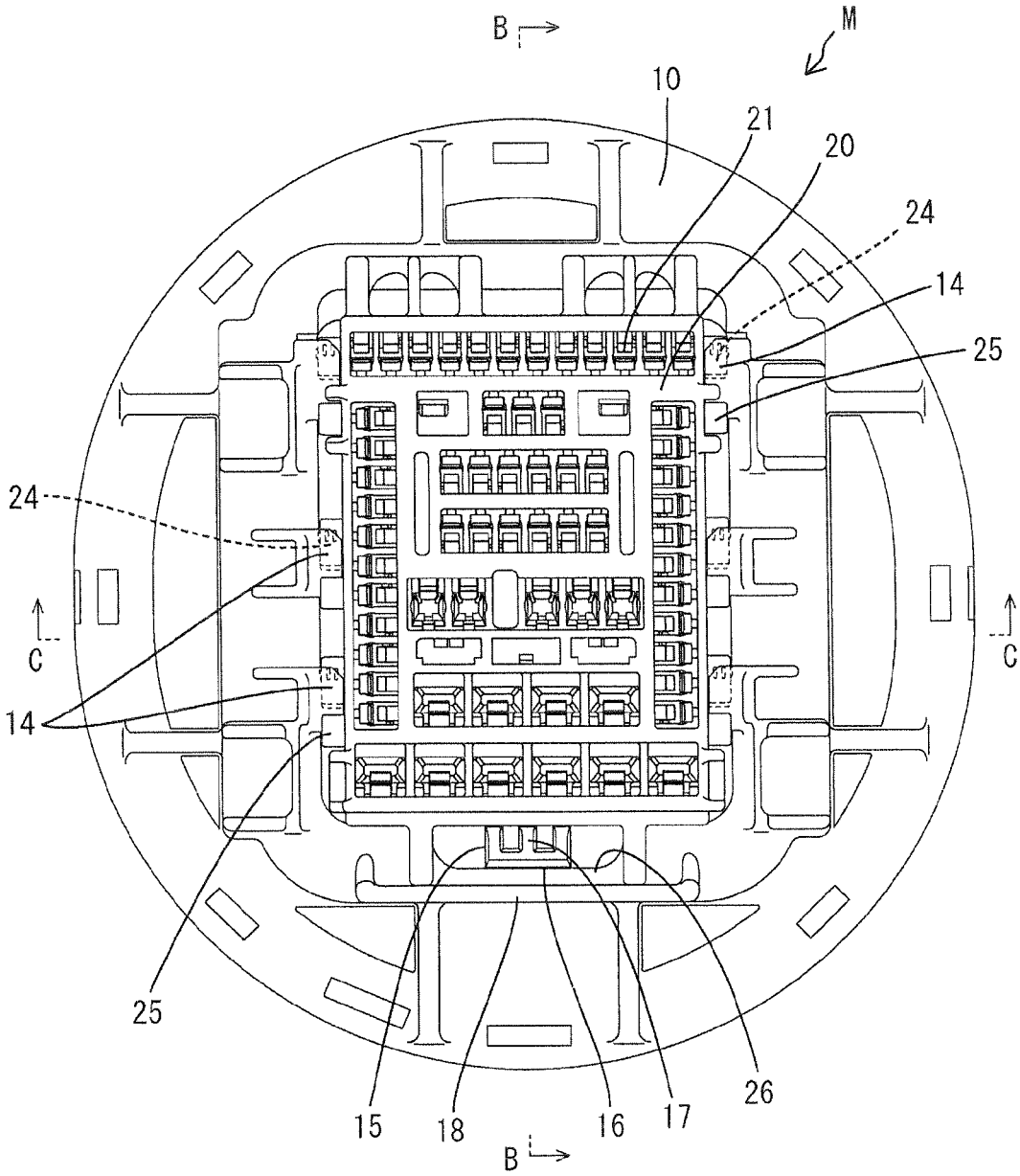
FIG. 7 is a rear view showing a state in which the terminal fitting accommodation member is mounted on the tube.
Figure 8:
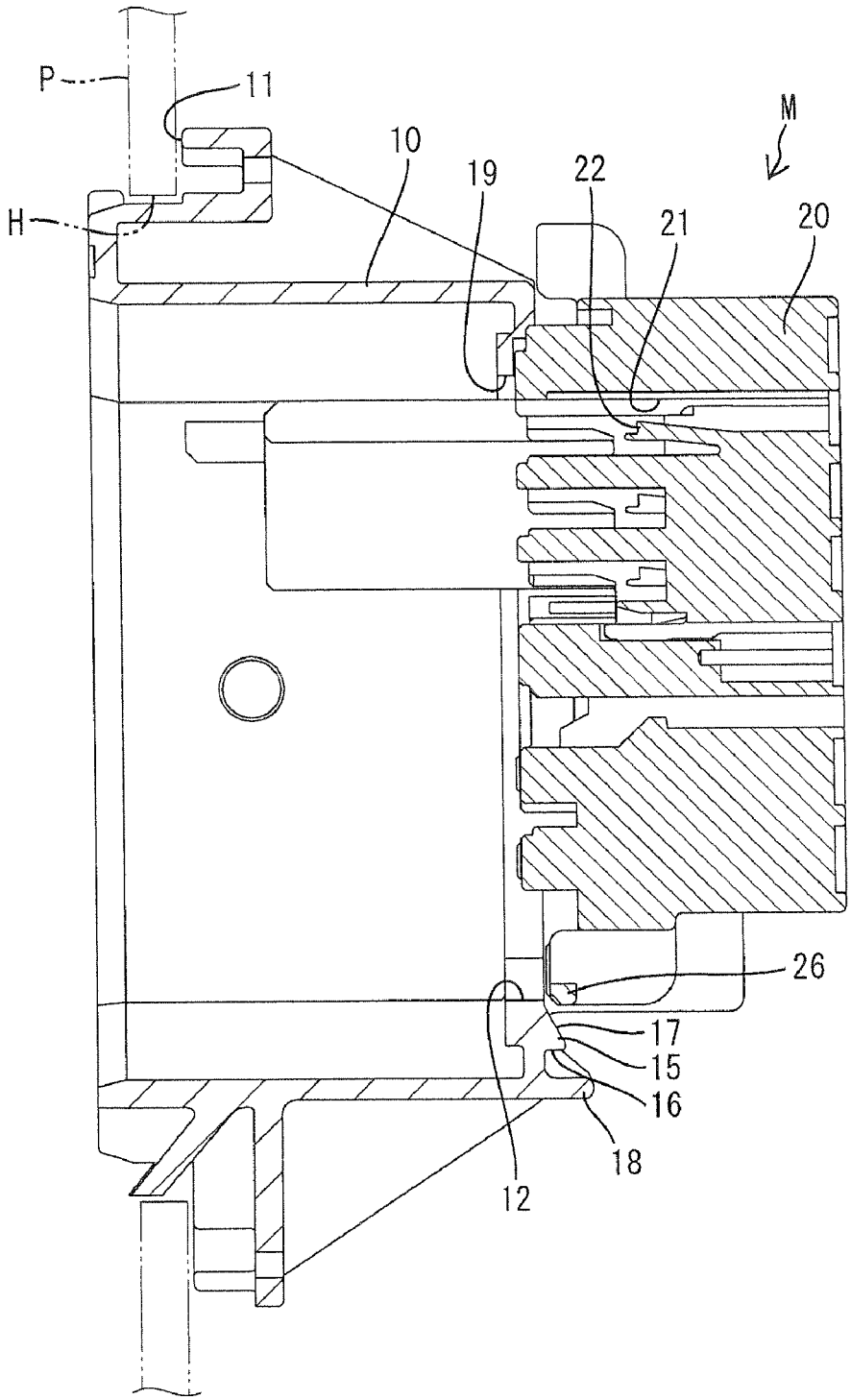
FIG. 8 is a sectional view taken along a line A-A of FIG. 6.

The locking bar 26 rides across the locking projection 15 when the terminal fitting accommodation member 20 reaches a predetermined normal mounted position on the tube 10, as shown in FIGS. 7 and 9. Thus, the locking bar 26 elastically returns to its original state and engages the locking surface 16 of the locking projection 15 from below. Accordingly, the terminal fitting accommodation member 20 is locked and prevented from moving up and away from the tube 10. At this time, the locking bar 26 rides across the locking projection 15, and strikes the stop 18 from above. As a result, the terminal fitting accommodation member 20 is prevented from moving down beyond the normal position in the direction in which the terminal fitting accommodation member 20 is mounted on the tube 10.

The front projection 24 contacts the prevention portion 14 from the front when the terminal fitting accommodation member 20 is mounted on the tube 10 at the predetermined normal position shown in FIG. 10. Thus, the terminal fitting accommodation member 20 cannot be displaced rearward from the tube 10. Further the rear projection 25 contacts the prevention portion 14 from the rear to prevent the terminal fitting accommodation member 20 from being displaced forward from the tube 10. Accordingly, the terminal fitting accommodation member 20 is placed longitudinally in position with respect to the tube 10.

The male terminal fittings 30 are mounted in the terminal fitting insertion spaces 21 of the terminal fitting accommodation member 20 from the rear after the terminal fitting accommodation member 20 is mounted on the tube 10. The tabs 32 at the front ends of the male terminal fittings 30 project forward from the front surface of the terminal fitting accommodation member 20 and into a space surrounded by the tube 10 when the male terminal fittings 30 are mounted in the respective terminal fitting insertion spaces 21. Thus, foreign matter cannot interfere with the tabs 32.

The detector 40 is mounted on the terminal fitting accommodation member 20 from the front after all of the male terminal fittings 30 are mounted in the respective terminal fitting insertion spaces 21.

The detection projections 41 enter the respective flexible spaces 23, as shown in FIG. 12, when the detector 40 is mounted on the terminal fitting accommodation member 20. The presence of the detection projection 41 into the corresponding flexible space 23 prevents each lance 22 from flexing elastically away from the male terminal fitting 30. Therefore the lance 22 and the detection projection 41 securely prevent the male terminal fitting 30 from being removed from the terminal fitting accommodation member 20.

A male terminal fitting 30 may be inserted incompletely into the terminal fitting insertion space 21. In this situation, the lance 22 pressed by the incompletely inserted male terminal fitting 30 remains in the flexible space 23. As a result, the detection projection 41 strikes the lance 22 in the flexible space 23 when the detector 40 is mounted on the terminal fitting accommodation member 20 and it is impossible to mount the detector 40 on the terminal fitting accommodation member 20. On the other hand, all of the lances 22 are disposed outside the flexible space 23 when all of the male terminal fittings 30 are mounted correctly in the respective terminal fitting insertion spaces 21. Thus, the detection projection 41 can be mounted smoothly on the terminal fitting accommodation member 20. Therefore it is possible to detect the mounted state of the male terminal fittings 30 based on whether the detector 40 can be mounted on the terminal fitting accommodation member 20.

Figure 14:
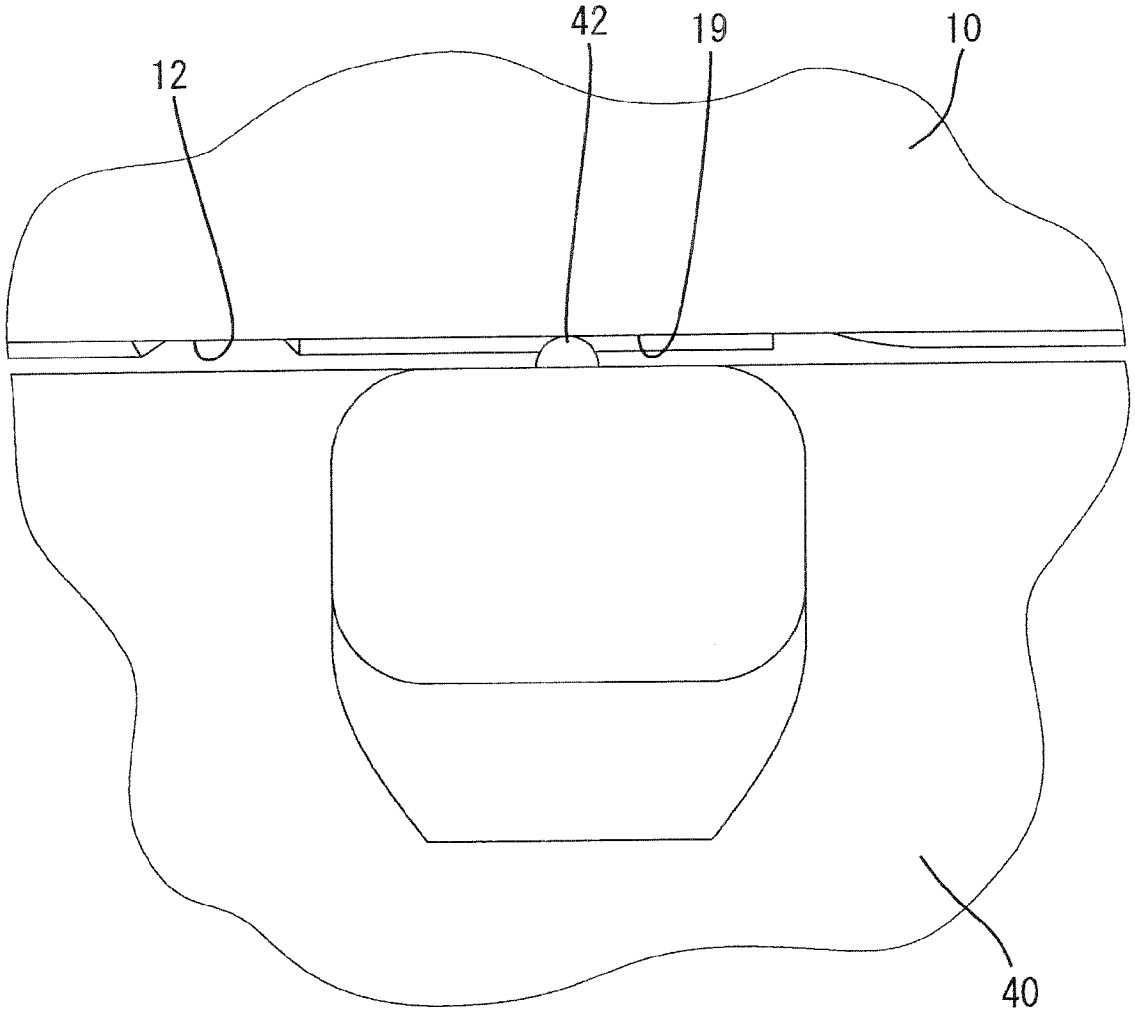
FIG. 14 is a partly enlarged front view showing a state in which the detector is mounted on the terminal fitting accommodation member.
Figure 15:
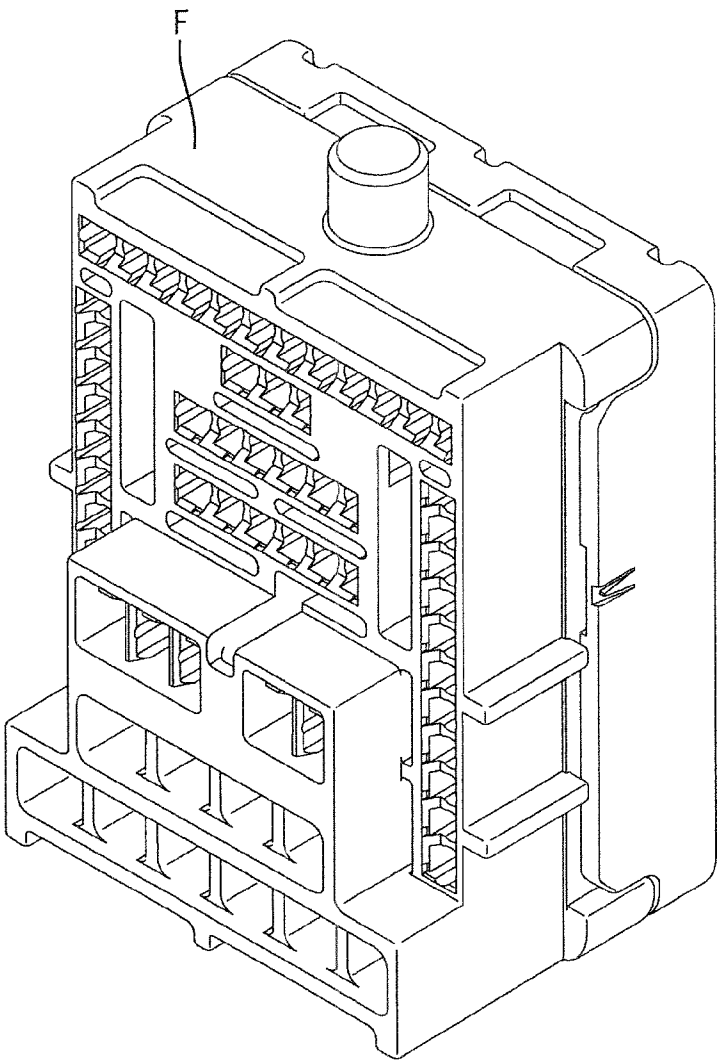
FIG. 15 is a perspective view showing a female housing.

The pressing projections 42 on the upper surface of the detector 40 contact the contact surface 19 on the inner surface of the fit-in hole 12 from below, as shown in FIG. 14 when the detector 40 is mounted on the terminal fitting accommodation member 20. The detector 40 is pressed down relative to the tube 10 due to the contact between the pressing projections 42 and the contact surface 19. Thus, the terminal fitting accommodation member 20 on which the detector 40 has been mounted also is pressed down with respect to the cylindrical tube 10 so that the locking bar 26 is pressed against the stop 18. Therefore, the terminal fitting accommodation member 20 is prevented from vertically loosening with respect to the tube 10 and is placed securely in position in the vertical direction. In this manner, the connector M is assembled.

Figure 16:
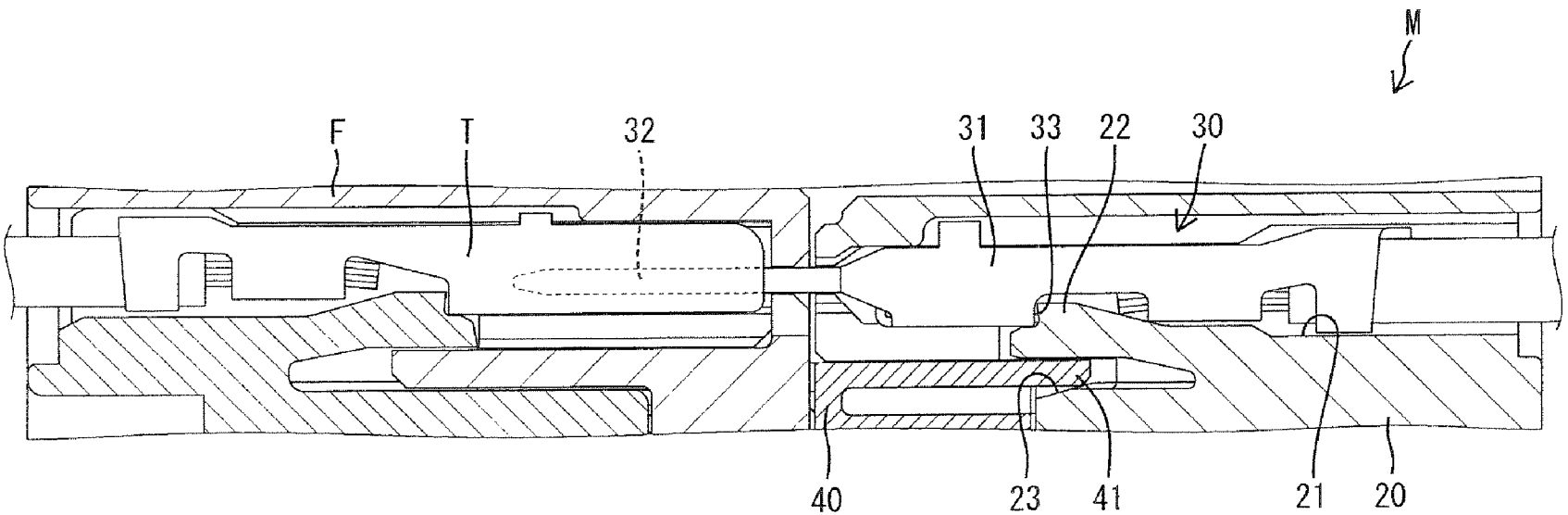
FIG. 16 is a sectional view showing the female housing fit in the terminal fitting accommodation member to connect male and female terminal fittings.

The female housing F is fit in the fit-in hole 12 of the tube 10 of the connector M from the front, as shown in FIG. 16. As a result, the tabs 32 of the male terminal fittings 30 penetrate into the female housing F and are connected electrically to the respective female terminal fittings T. At this time, the male terminal fittings 30 and the female terminal fittings T are connected smoothly to each other because the terminal fitting accommodation member 20 is placed in position with respect to the tube 10 and the fit-in hole 12 thereof.

The connector M is constructed by mounting the terminal fitting accommodation member 20 on the separately formed tube 10. Therefore when the number of poles of the male terminal fittings 30 is altered, the newly produced terminal fitting accommodation member 20 is mounted on the existing tube 10 to obtain a connector M. That is, the tube 10 is used for the newly produced connector M when altering the number of the poles of the male terminal fittings 30. It is only necessary to produce a die for forming the terminal fitting accommodation member 20. The die does not have a molding portion for molding the tube 10, and therefore has a simple configuration. The more simply configured die has a lower production cost. Therefore the connector M allows a decrease in the cost for producing the die.

A clearance for performing a smooth operation of mounting the terminal fitting accommodation member 20 on the tube 10 is provided therebetween. Thus there is a fear that a small amount of loosening occurs in the direction in which the terminal fitting accommodation member 20 is mounted on the tube 10. However, the terminal fitting accommodation member 20 is mounted on the tube 10 in the vertical direction intersecting with the longitudinal direction in which the female housing F is fit in the tube 10. Therefore, there is no fear that the area of the connection between the tab 32 and the female terminal fitting T becomes unstable even though loosening may occur in the direction in which the terminal fitting accommodation member 20 is mounted on the tube 10.

The terminal fitting accommodation member 20 is pressed rearward due to a connection resistance between the female terminal fitting T and the tab 32 when the female housing F is fit inside the tube 10 from the front. However, the terminal fitting accommodation member 20 is prevented from being displaced longitudinally due to the contact operation between the front projection 24 and the prevention portion 14. Therefore the area of the connection between the female terminal fitting T and the tab 32 is obtained securely.

The contact between the pressing projection 42 and the contact surface 19 causes the detector 40 to press the terminal fitting accommodation member 20 to the stop 18 when the detector 40 is mounted on the terminal fitting accommodation member 20. Therefore, the terminal fitting accommodation member 20 is held at a correct position with respect to the tube 10.

The invention is not limited to the above-described embodiment. For example, the following embodiments are included in the scope of the invention.

The tube may be formed from material other than synthetic resin, such as metal.

The direction in which the terminal fitting accommodation member is mounted on the tube may be parallel with the direction (longitudinal direction) in which the female housing is fit in the tube.

It is possible to adopt a mode in which the detector is not mounted on the terminal fitting accommodation member.

What is claimed is:

1. A connector comprising:

a terminal fitting accommodation member having terminal fitting insertion spaces extending in a longitudinal direction, the terminal fitting accommodation member further having at least one lock;

a tube formed separate from the terminal fitting accommodation member and having opposite front and rear ends, the front end of the tube being mounted in a mounting hole of a panel, the rear end of the tube being mounted to the terminal fitting accommodation member, a stop for preventing said terminal fitting accommodation member from being displaced beyond a correct mounting position, the tube further having at least one lock that engages the lock of the terminal fitting accommodation member when the terminal fitting accommodation member is at a correct mounting position relative to the tube for preventing the terminal fitting accommodation member from being displaced away from the tube;

terminal fittings accommodated in the terminal fitting insertion spaces of the terminal fitting accommodation member, each of the terminal fittings having a tab that projects from a front end surface of said terminal fitting accommodation member and into a space surrounded by said tube;

a female housing being fit in the front end of said tube, female terminal fittings accommodated inside said female housing and being connected respectively with said tabs; and said terminal fitting accommodation member being configured for mounting on said tube in a direction intersecting a direction in which said female housing is fit in said tube.

2. The connector of claim 1, wherein said tube has a prevention portion that allows an operation of mounting said terminal fitting accommodation member on said tube, but prevents longitudinal displacement of the terminal fitting accommodation member relative to the tube.

3. The connector of claim 1, wherein said terminal fitting accommodation member has a detector for detecting whether said terminal fitting has been accommodated correctly in said terminal fitting accommodation member.

4. The connector of claim 3, wherein said detector and said tube have contact portions that contact each other when said detector has been mounted on said terminal fitting accommodation member, wherein contact between said contact portions of said detector and said tube press said terminal fitting accommodation member to said stop.

5. A connector comprising:

a tube having opposite front and rear ends and a fit-in hole between the ends, the fit-in hole having opposite first and second side edges defining a width and top and bottom surfaces defining a height, first and second projections projecting rearwardly from the respective first and second side edges of the fit-in hole and first and second prevention portions projecting inwardly at rear ends of the respective first and second projections, a spacing between opposite first and second prevention portions being less than the width of the fit-in hole, the tube further having a locking projection in proximity to the bottom surface of the fit-in hole; and a terminal fitting accommodation member formed separately from the tube and being mounted to the tube, the terminal fitting accommodation member having opposite first and second side surfaces defining a width corresponding to the spacing between the first and second prevention portions, a bottom surface extending transversely between the side surfaces, front and rear projections projecting transversely from each of the first and second side surfaces of the terminal fitting accommodation member, the front projections engaging front surfaces of the prevention portions and the rear projections engaging rear surfaces of the prevention portions for limiting longitudinal movement of the terminal fitting accommodation member relative to the tube, a locking bar extending transversely on the terminal fitting accommodation member in proximity to the bottom surface thereof and engaging the lock for limiting transverse movement of the terminal fitting accommodation member.

6. The connector of claim 5, wherein the tube further comprises a stop disposed so that the lock is between the stop and the fit-in hole, the locking bar being engaged between the lock and the stop to limit transverse movement of the terminal fitting accommodation member relative to the tube.

7. The connector of claim 5, wherein the front projections are offset from the rear projections in directions parallel to the side edges of the fit-in hole.

8. A connector system, comprising:

a tube having opposite front and rear ends and a fit-in hole between the ends, the fit-in hole having selected internal dimensions; and a first terminal fitting accommodation member formed separately from the tube and having external dimensions corresponding to the internal dimensions of the fit-in hole so that the first terminal fitting accommodation member is mountable to the fit-in hole of the tube, and having a first selected number of terminal fitting insertion spaces extending in a longitudinal direction for accommodating terminal fittings; and a second terminal fitting accommodation member formed separately from the tube and having external dimensions corresponding to the internal dimensions of the fit-in hole so that the second terminal fitting accommodation member is mountable to the fit-in hole of the tube, and having a second selected number of terminal fitting insertion spaces extending in a longitudinal direction for accommodating terminal fittings, the second selected number being different from the first selected number, wherein either of the first and second terminal fitting accommodation members is mounted to the tube for accommodating a specified number of terminal fittings.

9. The connector system of claim 8, wherein the fit-in hole has opposite first and second side edges defining a width, first and second projections projecting rearwardly from the respective first and second side edges of the fit-in hole and first and second prevention portions projecting inwardly at rear ends of the respective first and second projections, a spacing between opposite first and second prevention portions being less than the width of the fit-in hole, front and rear projections projecting transversely from each of the terminal fitting accommodation members, the front projections being engageable with front surfaces of the prevention portions and the rear projections being engageable with rear surfaces of the prevention portions for limiting longitudinal movement of the terminal fitting accommodation member relative to the tube.

10. The connector system of claim 8, wherein a lock is formed in proximity to the fit-in hole and wherein each of the terminal fitting accommodation members has a locking bar that is engageable with the lock for preventing separation of the respective terminal fitting accommodation member from the tube.

11. The connector system of claim 10, wherein the tube further comprises a stop disposed so that the lock is between the stop and the fit-in hole, the locking bar engaging the stop to limit transverse movement of the respective terminal fitting accommodation member relative to the tube.

12. A connector comprising:

a terminal fitting accommodation member having terminal fitting insertion spaces extending in a longitudinal direction for accommodating terminal fittings;

a tube formed separate from the terminal fitting accommodation member and having opposite front and rear ends, the front end of the tube being mounted in a mounting hole of a panel, the rear end of the tube being mounted to the terminal fitting accommodation member, the tube having a stop for preventing said terminal fitting accommodation member from being displaced beyond a correct mounting position; and a detector for detecting whether said terminal fitting has been accommodated correctly in said terminal fitting accommodation member, wherein said detector and said tube have contact portions that contact each other when said detector has been mounted on said terminal fitting accommodation member, wherein contact between said contact portions of said detector and said tube presses said terminal fitting accommodation member to said stop.

13. The connector of claim 12, wherein said terminal fitting has a tab that projects from a front-end surface of said terminal fitting accommodation member and into a space surrounded by said tube;

a female housing being fit in the front end of said tube, and a female terminal fitting accommodated inside said female housing and being connected with said tab; and said terminal fitting accommodation member being mounted on said tube in a direction intersecting a direction in which said female housing is fit in said tube.

14. The connector of claim 12, wherein said tube has a prevention portion that allows an operation of mounting said terminal fitting accommodation member on said tube, but prevents longitudinal displacement of the terminal fitting accommodation member relative to the tube.

15. The connector of claim 12, wherein said tube and said terminal fitting accommodation member have locks that engage each other when said terminal fitting accommodation member is at a correct mounting position for preventing said terminal fitting accommodation member from being displaced away from said tube.

* * * * *